US006109374A

United States Patent [19]

Burca et al.

[11] Patent Number: 6,109,374

[45] Date of Patent: Aug. 29, 2000

[54] ROLLER STABILIZER

[75] Inventors: Constantin Burca; Hugh Gardner; Jim MacPhail; John MacPhail; Constantin Sarbu, all of Calgary, Canada

[73] Assignee: Orbital Machinig and Manufacturing Ltd., Albeta, Canada

[21] Appl. No.: 09/057,586

[22] Filed: Apr. 9, 1998

[30] Foreign Application Priority Data

Apr. 10, 1997 [CA] Canada ..... 2202319

[51] Int. Cl.[7] ..... E21B 17/10

[52] U.S. Cl. ..... 175/325.3; 175/324; 175/337; 175/345; 175/348

[58] Field of Search ..... 175/325.3, 324, 175/337, 345, 346, 347, 348

[56] References Cited

U.S. PATENT DOCUMENTS

| | | | |
|---|---|---|---|
| 3,303,900 | 2/1967 | Kloesel, Jr. et al. | 175/339 |
| 3,306,379 | 2/1967 | Kloesel, Jr. et al. | 175/345 |
| 3,361,493 | 1/1968 | Melton | 175/325.3 |
| 3,494,432 | 2/1970 | Garrett | 175/345 X |
| 3,659,663 | 5/1972 | Dysart | 175/337 X |
| 3,907,048 | 9/1975 | Gray | 175/348 X |
| 4,013,325 | 3/1977 | Rear | 175/325.3 |
| 4,226,291 | 10/1980 | Spelts | 175/347 X |
| 4,231,437 | 11/1980 | Swersky et al. | 175/346 X |
| 4,561,508 | 12/1985 | Garrett | 175/347 |
| 4,765,417 | 8/1988 | Perkin et al. | 175/347 |
| 4,793,425 | 12/1988 | White | 175/346 X |
| 5,190,379 | 3/1993 | White | 175/325.3 X |
| 5,381,868 | 1/1995 | Schock | 175/346 |

*Primary Examiner*—Eileen Dunn Lillis
*Assistant Examiner*—Jong-Suk Lee
*Attorney, Agent, or Firm*—Sughrue, Mion, Zinn, Macpeak & Seas, PLLC

[57] ABSTRACT

An improved stabilizing tool includes a body with a pocket, and a roller rotatably disposed in the pocket. The body includes a fluid passageway formed axially therethrough. The passageway has a first zone wherein the pressure of the fluid is relatively high and a second zone wherein the pressure is relatively low. A first conduit provides fluid communication between the first zone and an interior of the roller for the ingress of fluid to the interior, and a second conduit provides fluid communication between the interior of the roller and the second zone for the egress of the fluid back to the fluid passageway.

33 Claims, 10 Drawing Sheets

ROLLER STABILIZER

FIELD OF THE INVENTION

The present invention relates to a stabilizing tool used in rock drilling and more particularly to a roller stabilizer for stabilizing the drilling action of a rock bit.

BACKGROUND OF THE INVENTION

The use of stabilizer tools for stabilizing the action of a rotary rock bit and the attached drill string is well know. An example of such a tool may be seen from U.S. Pat. No. 4,013,325 granted to Rear on Mar. 22, 1977. The stabilizer fits between the rock bit and the drill string and consists of a cylindrical body with typically three or more carbide studded rollers set into the stabilizer body and arranged around its circumference. The rollers are axially aligned with the body and when set in place, protrude radially outwardly from the stabilizer's outer surface. The rollers contact the bore hole wall and help prevent the bit from "walking" to produce a straighter hole. The rollers also grind away overhangs or loose rock to create a smoother bore. The rollers are driven by frictional contact with the hole wall and therefore counter-rotate relative to the drill bit.

Drilling fluid, which may be a gas (pressurized air) or a liquid, passes axially through the stabilizer to the rock bit and carriers the cuttings back to the surface in the annulus between the bore hole and the drill string. Some or all of the drilling fluid passing through the stabilizer is directed through the shafts that rotatably support the rollers in the stabilizer to cool the rollers. Lubricant entrained or suspended in the drilling fluid is also delivered in this way to some of the exposed bearing surfaces between the shafts and rollers.

Stabilizers currently in use are prone to excessive wear. This necessitates costly repairs and maintenance, causes down time and ultimately leads to disposal of the tool when beyond repair. Wear is aggravated by the ingress of dust and cuttings into the rollers. One of the results of this wear is that drilling fluid diverted through the rollers for cooling purposes begins to escape into the bore hole annulus. If sufficient fluid begins to leak, there will be a loss of circulation at the bit so that the cuttings are no longer carried away efficiently. More importantly, rotary rock bits cannot function properly without adequate air pressure in the bit and a loss of air from the stabilizer will negatively affect the bit's performance. Drilling must then be stopped for stabilizer repair or replacement.

SUMMARY OF THE INVENTION

It is therefore an object of the present invention to obviate and mitigate from the disadvantages of prior stabilizers.

It is a further object of the present invention to better seal the rollers to reduce wear, increase tool life, facilitate lubrication of the rollers, and to better prevent loss of drilling fluid.

According to the present invention, then, there is provided a stabilizing tool for drilling having a plurality of roller assemblies disposed in pockets about the surface of the tool, the assemblies each including at least one rotatable grinding roller disposed for frictional contact with the walls of a bore hole being drilled, said tool comprising a fluid passageway formed axially therethrough for the flow of drilling fluid, said passageway having a first zone wherein the pressure of said fluid is relatively high and a second zone wherein said pressure is relatively low; and means placing said passageway in fluid communication with the interior of respective ones of said rollers, said means including first conduit means providing fluid communication between said zone of relatively high pressure and the interior of said roller for the ingress of said fluid to said interior, and second conduit means providing fluid communication between the interior of said roller and said zone of relatively low pressure for the egress of said fluid back to said passageway.

According to another aspect of the present invention, there is also provided a roller assembly for a stabilizing tool used for drilling, the assembly comprising a roller; a shaft to rotatably support said roller thereon; a sealed annular space between said roller and shaft; and a flow path for fluid into and then out from said sealed annular space for cooling of said roller.

According to yet another aspect of the present invention, there is also provided a roller assembly for a stabilizing tool used for drilling, said tool having a pocket formed therein for each roller assembly, said roller comprising a roller; a shaft to rotatably support said roller thereon; and sleeve means adapted to fit over and partially circumferentially enclose said roller and shaft, leaving said roller partially exposed for frictional contact with the surface of a bore hole being drilled, said sleeve means enclosing enough of said roller to prevent lateral separation of said roller from said sleeve means.

According to yet another aspect of the present invention, there is also provided a method of cooling a grinding roller disposed on the surface of a stabilizer tool used in the drilling of bore holes, the method comprising the steps of rotatably mounting said roller on a shaft so that an annular space is formed between said roller and shaft; and directing a cooling fluid into and then out from said annular space.

According to yet another aspect of the present invention, there is also provided a method of cooling a grinding roller disposed on the surface of a stabilizer tool used in the drilling of bore holes, the roller being rotatably mounted on a shaft supported in the tool, the method comprising the steps of forming a passageway through said stabilizer tool for the flow of drilling fluid; controlling the flow of said fluid through said passageway to establish a zone of relatively higher fluid pressure and a zone of relatively lower fluid pressure; creating a fluid tight annular space between said roller and said shaft; and establishing fluid communication between said zone of relatively higher fluid pressure and said annular space for the ingress of said fluid into said annular space, and fluid communication between said zone of relatively lower fluid pressure and said annular space for the egress of said fluid from said annular space.

BRIEF DESCRIPTION OF THE DRAWINGS

Preferred embodiments of the present invention will now be described in greater detail and will be better understood when read in conjunction with the following drawings, in which.

DETAILED DESCRIPTION

Figure 1:
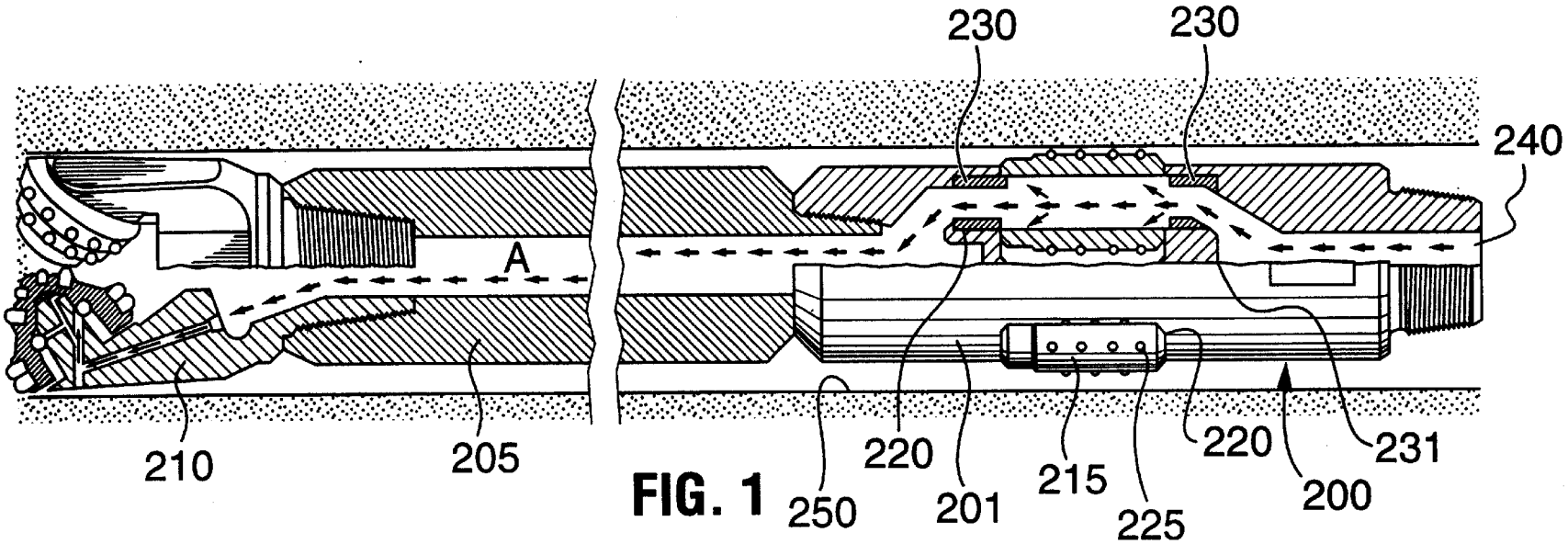
FIG. 1 is a schematical partially cross-sectional view of a prior art stabilizer illustrating the delivery of drilling fluid and entrained lubricant to the stabilizer rollers.

With reference to FIG. 1, a conventional stabilizer 200 is shown connected uphole of a rotary rock bit 210. The bit and stabilizer are shown separated by a tubular sub 205 but the use of a sub is optional and the bit and stabilizer are often threaded together directly.

Typically, three or more rollers 215 are rotatably supported in pockets 220 formed in the stabilizer body 201 with the rollers protruding beyond the body's outer surface. The outer surface of each roller is studded with carbide buttons 225 that frictionally engage the wall 250 of the bore hole which causes the rollers to rotate in the direction opposite rotation of the drill bit. Each roller is supported for rotation on a hollow shaft 230. The ends of the shaft are received into cylindrical sockets 231 formed into axially opposite ends of pocket 220. The interior of the hollow shafts are placed in fluid communication with the axial passageway 240 formed through the stabilizer for the flow of drilling fluid, which is usually compressed air. The drilling fluid, which may include an entrained airborne lubricant for the rock bit, is thusly directed through the roller assemblies for cooling and lubrication.

Typically, there is little or no sealing between the rollers and the shafts, or if there is sealing, it's relatively short lived and the inevitable ingress of dust and cuttings results in wear between the roller and shaft and between the shaft ends and sockets 231. As the wear increases, drilling fluid escapes through and around the roller assemblies into the bore hole annulus, increasing to the point where the air pressure at the bit is inadequate to sustain bit performance and to carry away the cuttings effectively.

We are proposing an improved stabilizer with greater sealing between the roller and shaft. This permits the use of bearings and wear sleeves between the roller and shaft. The sealing and other features of the stabilizer to be described below results in a greater delta pressure across the roller assemblies to more effectively draw cooling fluid and lubricant into and through the assembly for greater cooling and lubrication of the bearings. This improves roller life and significantly increases each stabilizer's footage prior to the need for repair and/or replacement. As well, in the event of even catastrophic roller failure, it is anticipated that fluid loss will still be insufficient to badly affect bit performance.

Figure 2:
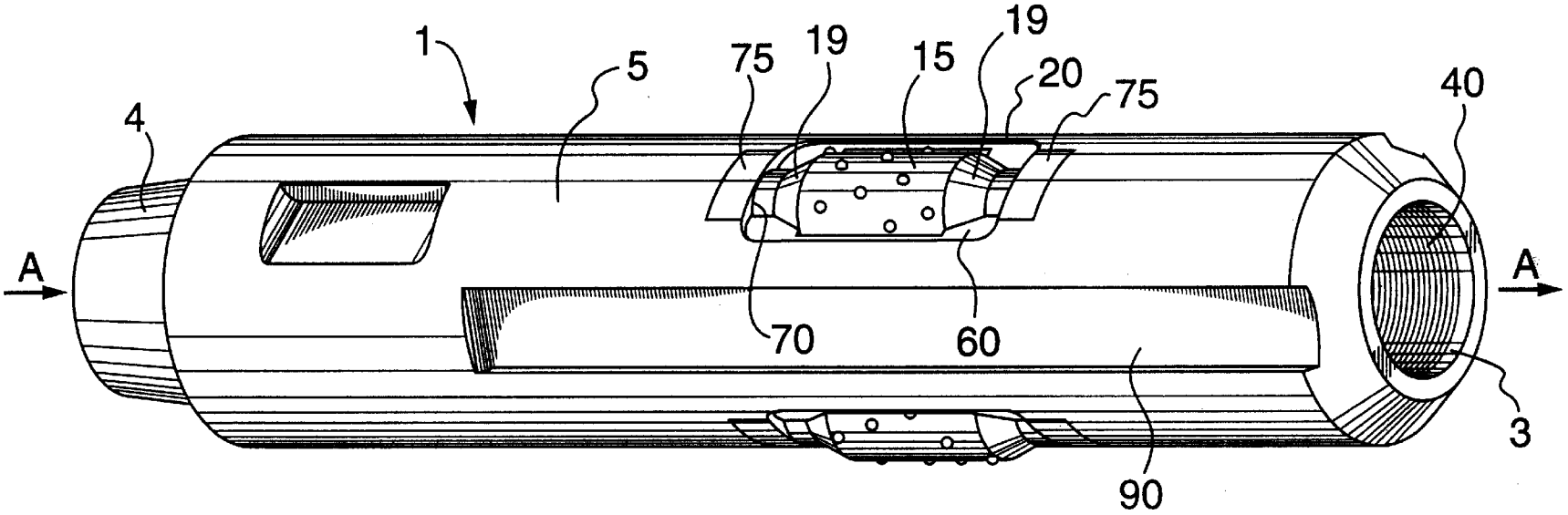
FIG. 2 is a perspective view of the present stabilizer with the rollers installed and clamped in place.

Reference will now be made to FIG. 2 and subsequent Figures in which like reference numerals have been used to identify like elements. As seen in FIG. 2, the present stabilizer 1 comprises a one piece tubular body 5 internally box threaded at its down hole end 3 for connection to a rock bit and externally box threaded at its uphole end 4 for connection to the drill string (not shown). An axial passageway 40 extends through the stabilizer from one end to the other for the flow of drilling fluid and lubricant usually in the direction of Arrow A. In the embodiment shown, the stabilizer includes three carbide-studded rotatable rollers 15 spaced at 120° intervals in pockets 20. Both ends 19 of each roller are tapered or chamfered to facilitate insertion and withdrawal of the tool from the bore hole.

Figure 3:
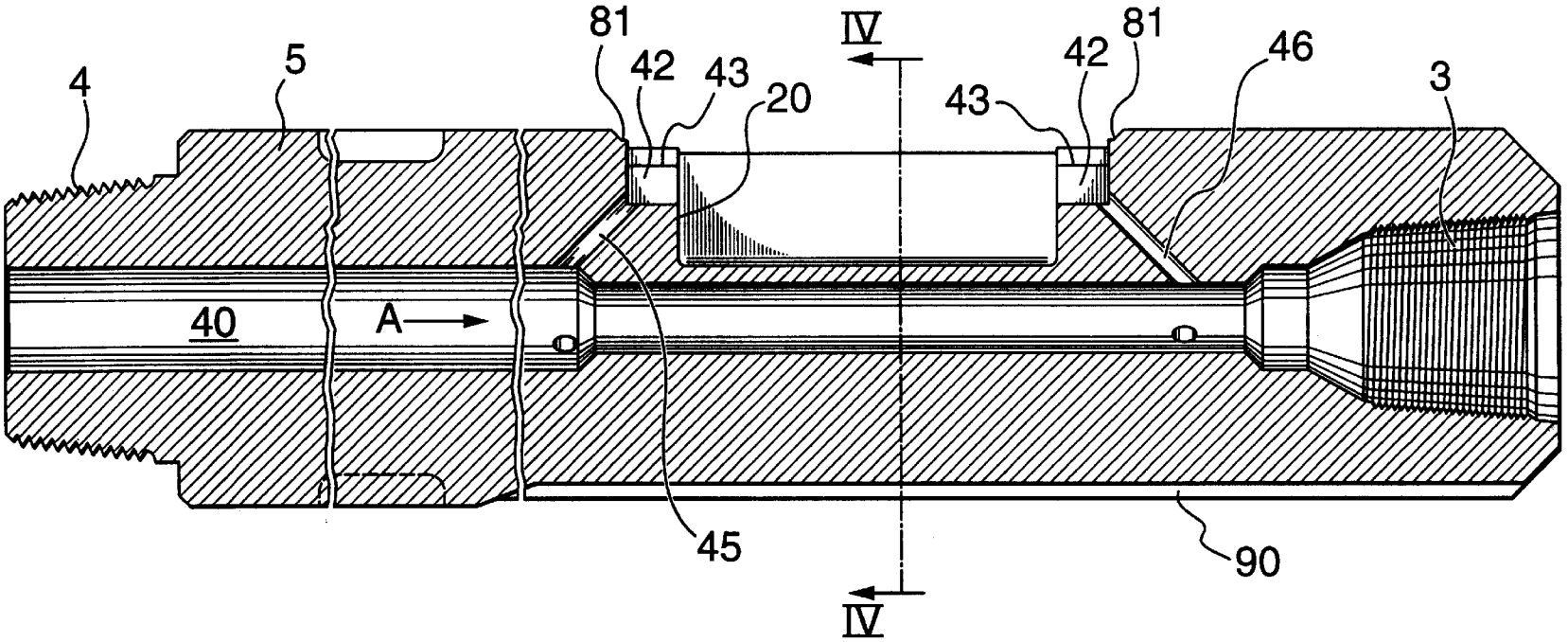
FIG. 3 is a side elevational cross-sectional view of the stabilizer body along the longitudinal axis thereof.
Figure 4:
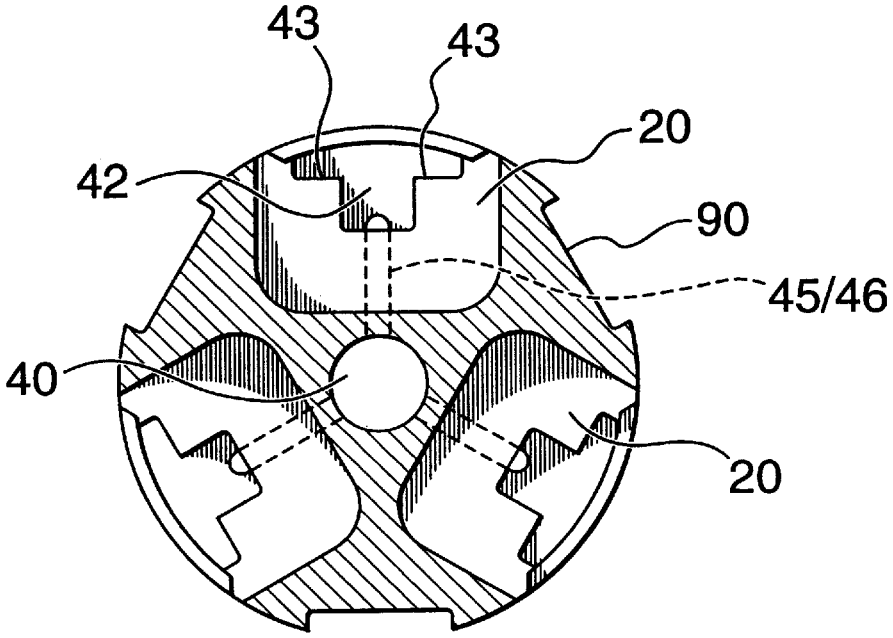
FIG. 4 is an end elevational, cross-sectional view of the stabilizer body of FIG. 3 along the line A—A.
Figure 5:
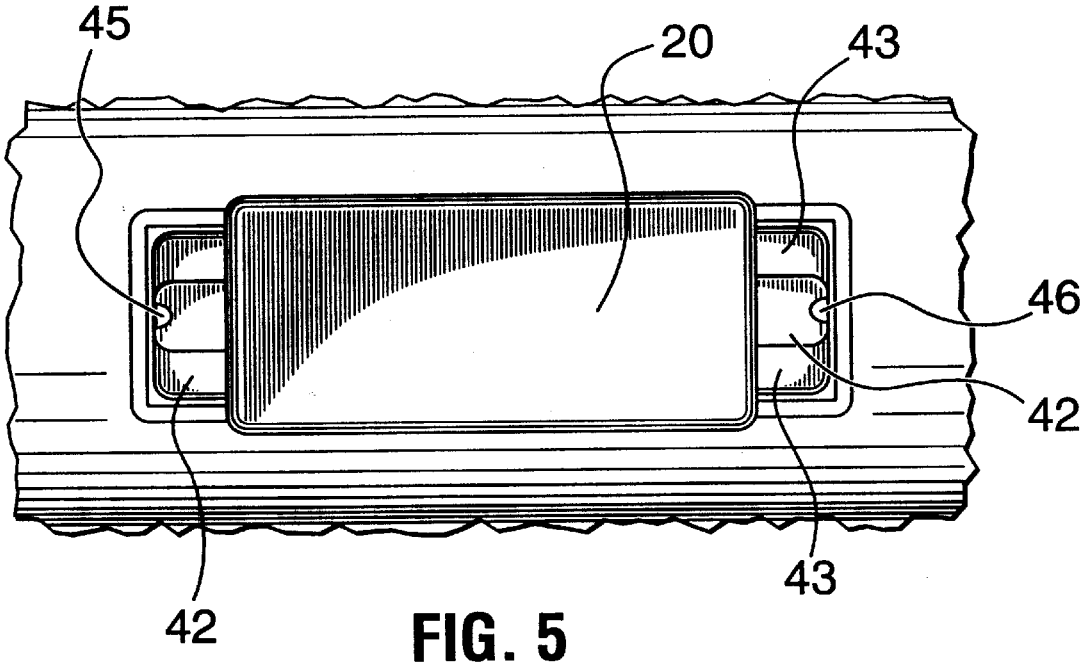
FIG. 5 is a plan view of a roller pocket formed into the stabilizer body of FIG. 3.

FIG. 3 is a cross-sectional view of the stabilizer body 5 along its major longitudinal axis with the roller assemblies removed. As will be seen, passageway 40 narrows in the area radially beneath pockets 20, providing more clearance for the required depth of these pockets and creating a zone in which the pressure of the drilling fluid is lower than in the wider section of the passage immediately uphole of the pockets. The pockets themselves, as best seen from FIGS. 3, 4 and 5, are substantially rectangular openings formed into the stabilizer body, with each pocket including at its opposite ends a rectangular notch 42 flanked by shoulders 43. Fluid passageways or conduits 45 and 46 extend diagonally between the lower corners of respective notches 42 and passageway 40. More specifically, conduit 45 at the uphole side of pocket 20 extends from notch 42 to the wider diameter, higher pressure (and lower fluid velocity) portion of passage 40, and conduit 46 extends from notch 42 at the downhole side of the pocket to the narrower, lower pressure (and higher fluid velocity) region of passage 40, As will be described below, this creates a delta pressure across the roller assembly which more effectively draws fluid and lubricant into and through the rollers.

Each pocket as aforesaid is adapted to support a roller assembly comprising in part a roller 15 (FIG. 9) and a shaft 30 (FIG. 6) that rotatably supports the roller. The roller shaft will be described first with reference to FIGS. 6, 7 and 8. Each shaft is symmetrical from one of its ends to the other and only one end therefore will be described in detail.

Figure 6:
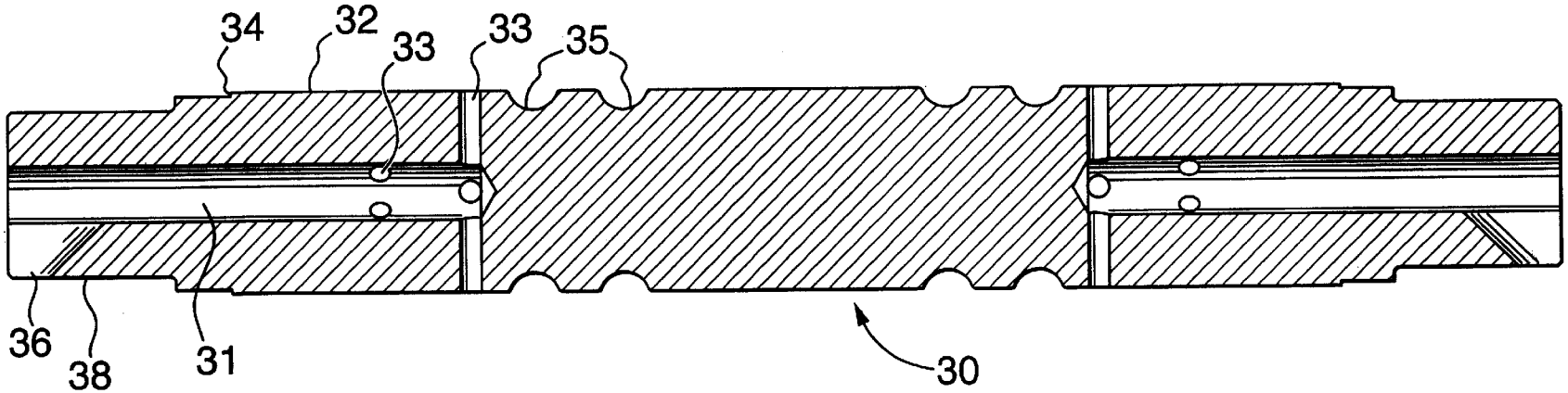
FIG. 6 is a side elevational, cross-sectional view of a roller shaft.

With reference to FIG. 6, it will be seen that unlike prior art roller shafts, shaft 30 is not hollow from one end all the way through to its other end. Instead, a passage 31 is formed only partially through the shaft, and fluid communication to the shaft's outer surface is provided by means of a plurality of ventilation holes 33. As will be described below, these holes will direct drilling fluid into an annulus 56 (FIG. 10) between the shaft and roller, and the holes at the downhole end of the shaft will exhaust this fluid back to main passageway 40. Axially inwardly of holes 33, at least one but preferably a pair of bearing races 35 is formed into the shaft's outer surface for ball bearings, and axially outwardly of the holes, the outer surface 32 of the shaft is polished for fluid sealing contact with one or more O-rings and a wear sleeve that will be described below.

Figure 7:
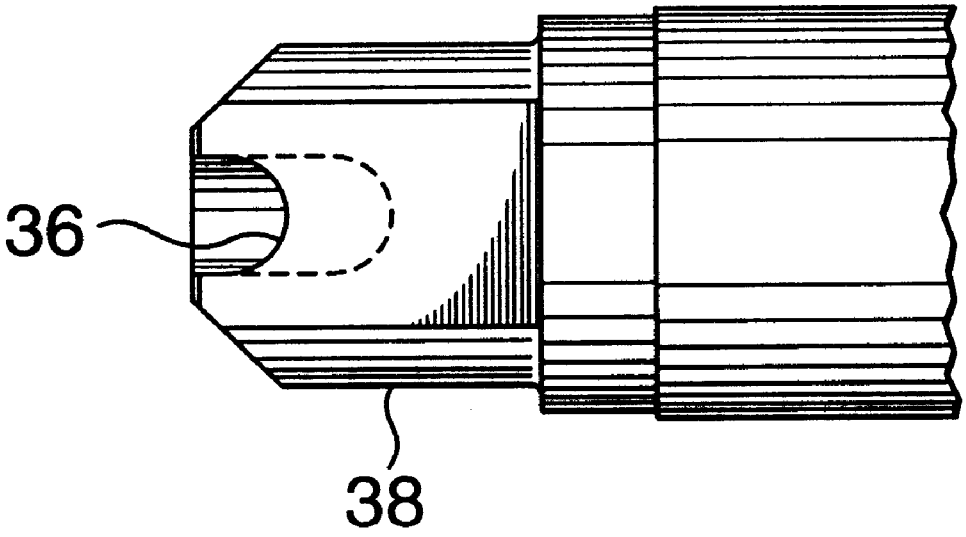
FIG. 7 is a bottom plan view of the end of the shaft of FIG. 6 looking in the direction of arrow B.
Figure 8:
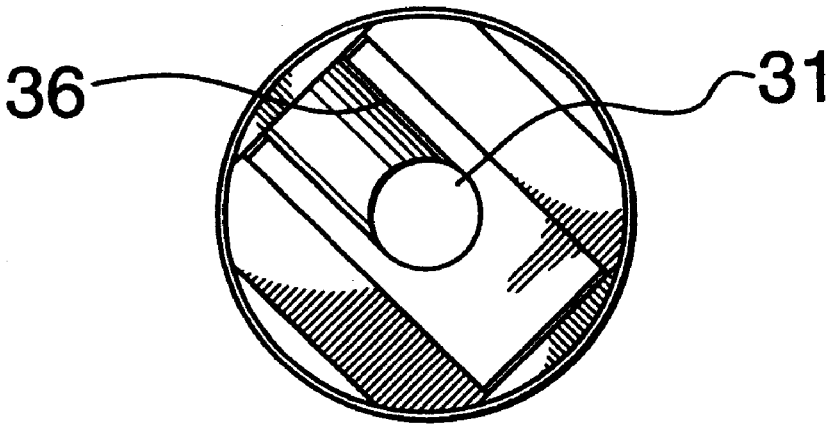
FIG. 8 is an end elevational view of the end of the shaft shown in FIG. 7.

With particular reference to FIGS. 7 and 8, the end 38 of shaft 30 is squared off for a close fit into notch 42 at the end of pocket 20. This prevents the shaft from rotating relative to the stabilizer body, and effectively eliminates wear between the shaft and the body. A notch 36 is formed into the squared end of the shaft to provide fluid communication between diagonal conduits 45/46 and passage 31.

Figure 9:
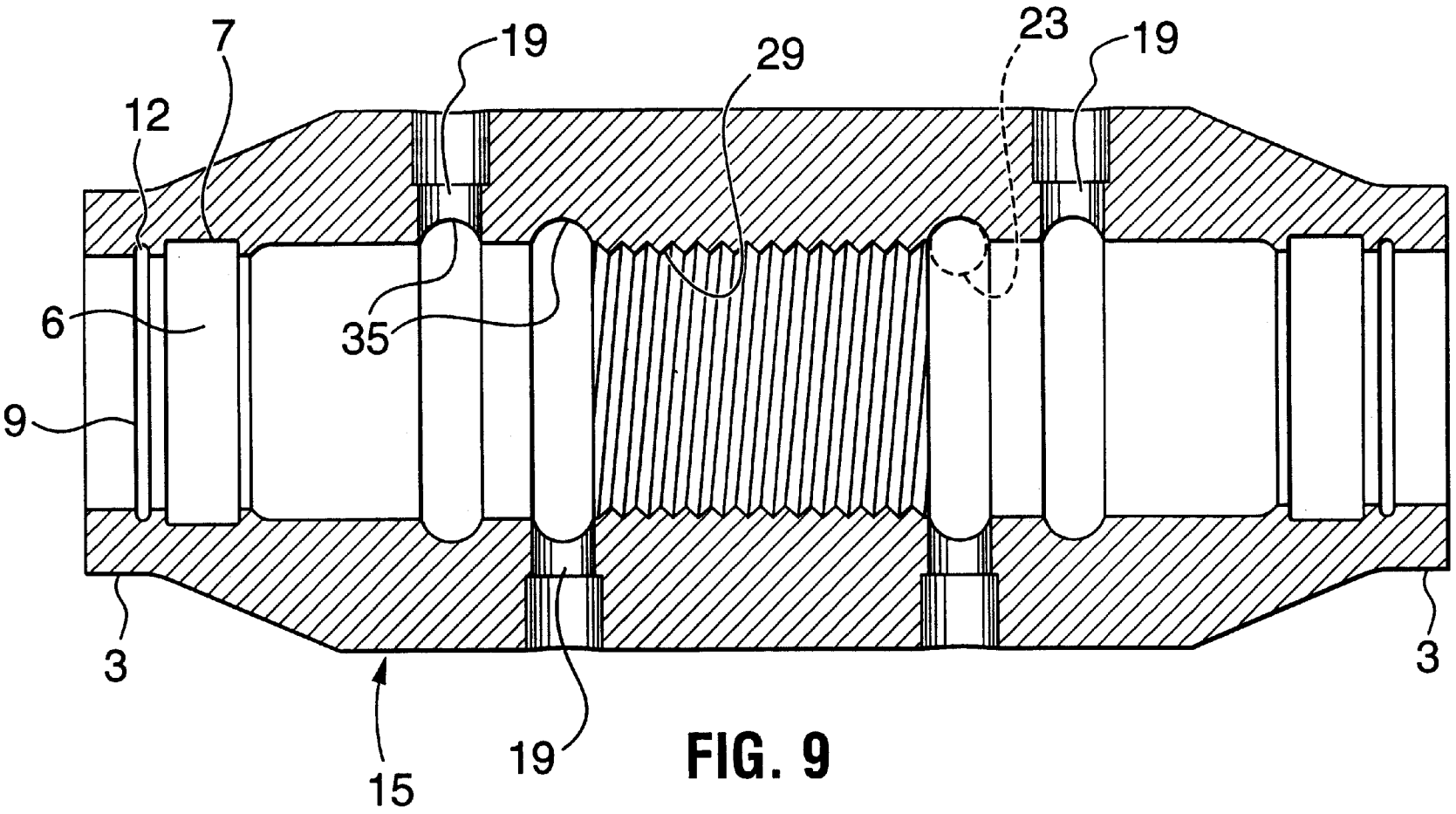
FIG. 9 is a side elevational, cross-sectional view of a stabilizer roller.
Figure 10:
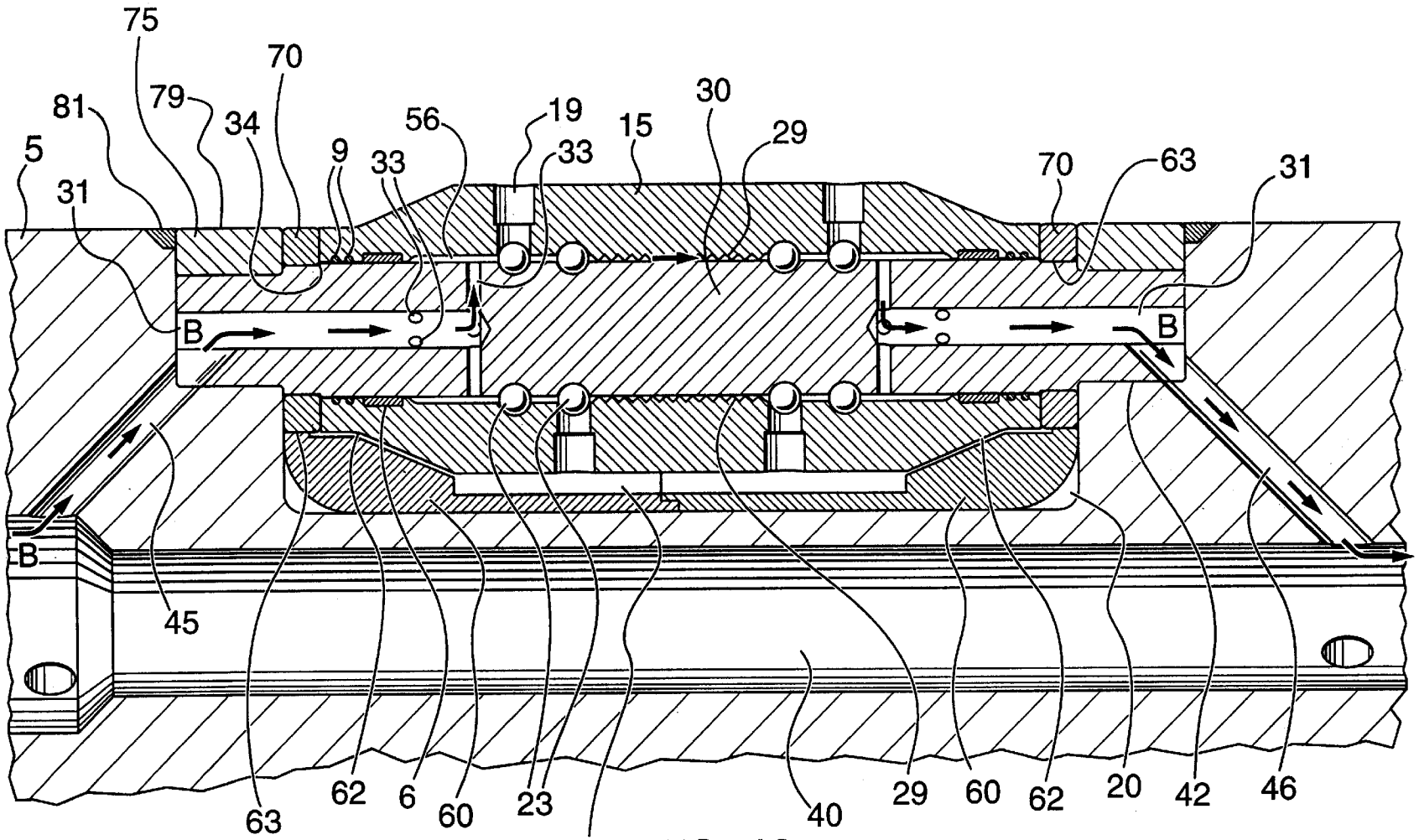
FIG. 10 is a side elevational cross-sectional view of the stabilizer body enlarged to show the assembly with a roller.
Figure 11:
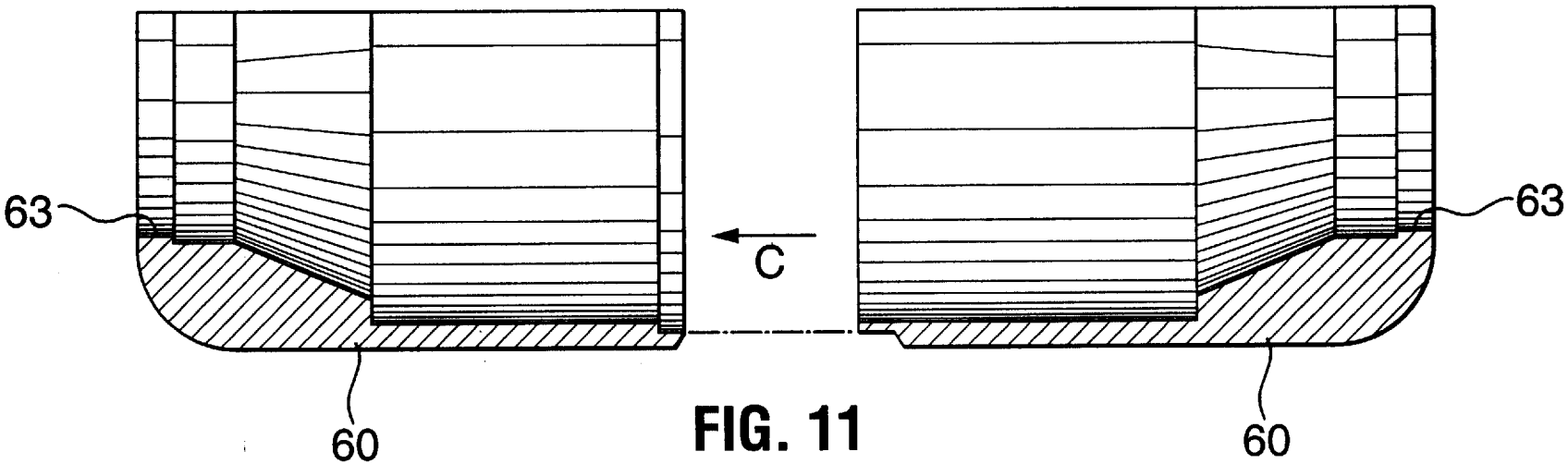
FIG. 11 is a side elevational, cross-sectional view of a split roller sleeve for supporting the roller of FIG. 9 in the stabilizer body.

With reference to FIGS. 9 and 10, roller 15 is sized and adapted to fit over shaft 30 so that there is an annular space 56 remaining between the two. As with the shaft, each roller is substantially symmetrical from one end to the other, and only one end will therefore be described in detail. As shown, the roller is hollow all the way through to provide clearance for shaft 30. Fluid-tight sealing between the roller and shaft is provided by means of one or more O-rings 9 located at the outer end of the roller by circumferential grooves 12 in the roller's inner surface so that the O-ring or rings seal against the polished outer surface 32 of the shaft. Inwardly of the O-rings, another circumferential groove 7 in the roller locates a composite wear sleeve 6 that also bears against polished shaft surface 32. Inwardly of the wear sleeve, at least one but preferably a pair of bearing races 35 are formed to be radially opposite the races 35 formed in the shaft. An opening 19 from the roller's outer surface to each race is formed so that after the roller is assembled on the shaft, ball bearings 23 can be dropped into the races until full. These openings are closed by means of threaded fasteners for example (not shown) that can then be welded shut. Holes 33 in the shaft for the flow of the drilling fluid and lubricant open into the annulus 56 between wear sleeve 6 and bearings 23. The normal direction of fluid flow is indicated by Arrows B.

It will be understood that reference to the use of ball bearings 23 and associated races 35 is exemplary in nature. Bearing support alternatives can include the use of sleeve or needle-type bearings, friction bearings or any other suitable alternatives that will occur to those skilled in the art.

Each of rollers 15 may include one or more helical threads 29 machined into its inner surface between the two sets of bearing races 35. This machined spiral creates a turbine effect that assists or could assist in distributing drilling fluid and lubricant from the uphole conduit 45, through bearings 23, into the sealed annulus 56 between the roller and shaft and then in exhausting the mixture through the downhole passage 46 back towards the rock bit. In one embodiment constructed by the applicants, threads 29 comprise 3 to 4 starts of 0.080" depth threads with preferably a wide spacing between the threads in the range, for example, of 0.100" to 0.250".

Figure 12:
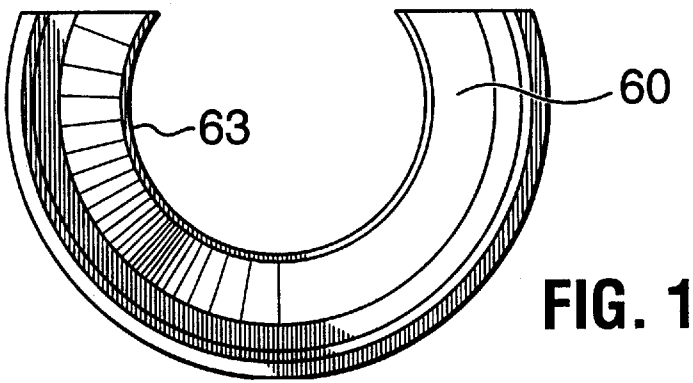
FIG. 12 is an end elevational view of one of the sleeves of FIG. 11 looking in the direction of arrow C.
Figure 13:
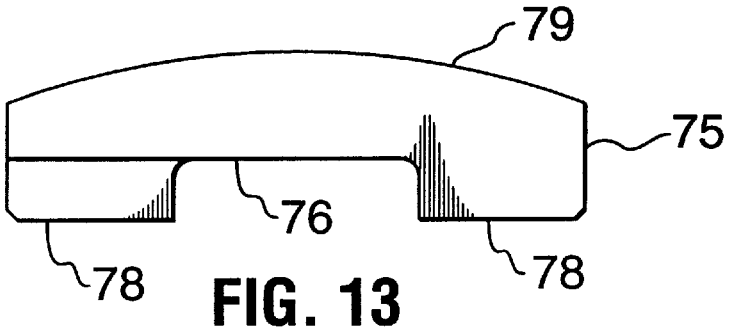
FIG. 13 is an end elevational view of a roller clamp.
Figure 14:
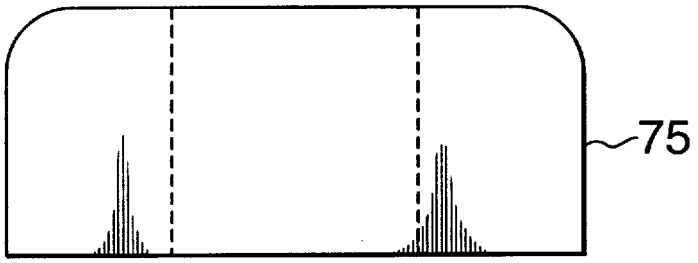
FIG. 14 is a plan view of the clamp of FIG. 13.
Figure 15:
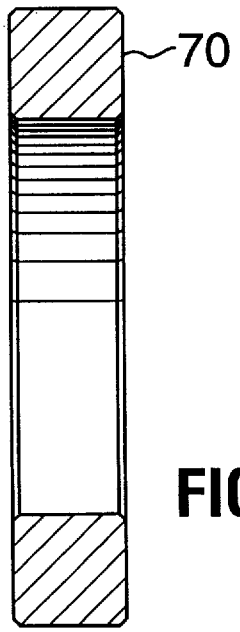
FIG. 15 is a cross-sectional view of a wear ring.

Before installing the shaft and roller assemblies into pockets 20, each assembly is first assembled with a split roller sleeve 60 and wear rings 70 as shown most clearly in FIG. 10. Rings 70 (see also FIG. 15), which will normally be metal, fit over respective ends of shaft 30 and are spotted in place by abutment with shoulders 34 machined into the shaft's outer surface. The two halves of split ring 60 are then assembled together to form a cradle for the roller assembly. Apertures 63 at the ends of the roller sleeve partially encircle wear rings 70, and the sleeve's body partially encircles the roller assembly. As seen best from the end view of FIG. 12, roller sleeve 60 is shaped to concentrically enclose more than half of the circumference of the wear rings and the roller assembly to prevent separation. The squared ends of shaft 30 extend axially from the completed assembly of the roller sleeve and the roller. This completed assembly is inserted into one of pockets 20 for a conformable fit thereinto as best seen from FIG. 2. When inserted into the pocket, the protruding squared ends of shaft 30 are received into notches 42. To lock the roller assemblies into the stabilizer, the ends of the shaft fitted into notches 42 are sealed off with metal clamps 75 shaped as shown in FIGS. 13 and 14.

The lower surface of each clamp includes a notch 76 to engage the portion of the squared end of the shaft that protrudes above notch 42. Flanking the notch on either side are a pair of feet 78 that abut against shoulders 43 (FIG. 4). The upper surface 79 of the clamp has the same curvature as the contiguous outer surface of the stabilizer body. As best seen from FIGS. 3 and 10, a portion 81 of the stabilizer body around the edge of the clamp is machined away to form a gutter for a weldment permanently connecting clamps 75 to the stabilizer body. The weldment can be polished for a seamless surface between the clamps and the body.

Sleeves 60 serve a number of purposes. They hold the rollers and wear rings 70 in place even in the event of shaft failure whereas otherwise the rollers in particular could eject from the stabilizer to jam the tool string in the hole. The sleeves, which are dimensioned so that the annular distance 62 to the rollers is constant, limit the ingress of cuttings into the area immediately surrounding the rollers. When replacement is eventually required the old roller and sleeve combination is removed and a new assembly inserted without the need to re-machine pockets 20. In addition, wear rings 70 act as thrust bearings for the rollers, particularly in the event that bearings 23 or races 35 begin to wear.

In operation, when the stabilizer is assembled and inserted between the rotary bit and the drill string, rollers 15 will rotate at speeds of approximately 300 to 350 rpm depending upon the rate of rotation of the rock bit. Drilling fluid and entrained lubricant will be drawn into uphole conduit 45, through notch 42 and into passage 31 in shaft 30. The mixture will then pass through holes 33 into annulus 56 between the roller and the shaft to pressurize the annulus and deliver lubricant and drilling fluid to cool and lubricate ball bearings 23 and other bearing surfaces between the roller and shaft. The drilling fluid/lubricant mixture is then exhausted through the downhole set of holes 33, through passage 31, notch 42, conduit 46 and back to axial passage 40 for flow through the remainder of the stabilizer. With conduit 45 drawing from a relatively low velocity, high pressure zone of passage 40, and conduit 46 exhausting into a relatively high velocity, low pressure zone of passage 40, a venturi-type effect is created that positively and continuously draws fluid and lubricant into the roller assembly and then exhausts the mixture downstream. The anticipated turbine effect from threads 29 should improve the distribution of the fluid/lubricant mixtures through the annulus and particularly across bearings 23. Roller life is substantially enhanced by the use of bearings and wear sleeves between the roller and shaft and the reliable delivery of lubricant and coolant to these components. The pressure developed in the annulus between the roller and shaft is contained by the O-rings and the anchoring of the shafts against rotation helps prevent the kinds of wear that would otherwise result in the escape of drilling fluid through the rollers into the bore hole annulus.

In one embodiment constructed by the applicant, stabilizer body 5 has been machined from 4140–4145 heat stress relieved tool steel. Shafts 30 have been made from AMS 6418 steel available commercially as HYTUFF™, and rollers 15 have been made from hardened steel available commercially as EN30B.

As will be appreciated, as the rollers are designed to make constant contact with the bore hole wall, the flow of cuttings back to the surface can be impeded. This causes the cuttings to swirl around the bottom section of the stabilizer downhole of the rollers until ground small enough to pass over the rollers. This swirling action results in severe wear on the stabilizer in the zone between the bit and the rollers.

To alleviate this problem, we have introduced longitudinally extending flutes 90 into the outer surface of the stabilizer body. These flutes create channels for the cuttings to more easily bypass the rollers to achieve longer body life and also less restriction on the velocity of the return flow of the cuttings to the surface.

The above-described embodiments of the present invention are meant to be illustrative of preferred embodiments of the present invention and are not intended to limit the scope of the present invention. Various modifications, which would be within the scope of the present invention. The only limitations to the scope of the present invention are set out in the following appended claims.

We claim:

1. A stabilizing tool for drilling having a plurality of roller assemblies disposed in pockets about the surface of the tool, the assemblies each including at least one rotatable grinding roller disposed for frictional contact with the walls of a bore hole being drilled, said tool comprising:

a fluid passageway formed axially through said tool for the flow of drilling fluid, said passageway having a first zone wherein the pressure of said fluid is relatively high and a second zone wherein said pressure is relatively low; and means for placing said passageway in fluid communication with the interior of each of said rollers, said placing means including first conduit means providing fluid communication between said first zone of relatively high pressure and the interior of said roller for the ingress of said fluid to said interior, and second conduit means providing fluid communication between the interior of said roller and said second zone of relatively low pressure for the egress of said fluid back to said passageway, said interior of each roller being sealed to prevent the ingress or egress of fluid other than through said first and said second conduit means.

2. The tool of claim 1 wherein each said roller assembly includes a shaft, a roller mounted rotatably on said shaft to define an annular space between said roller and said shaft, and a seal between said roller and said shaft at axially opposite ends of said annular space.

3. The tool of claim 2 wherein said shaft includes at each end thereof an axial fluid passage that extends only partially through said shaft, and means for placing each said passage in fluid communication with said annular space, said fluid passages being in respective fluid communication with said first and said second conduit means, wherein fluid from said first conduit means can flow into said annular space and then out from said annular space via said second conduit means.

4. The tool of claim 3 including bearing means disposed between said roller and shaft in said annular space to facilitate rotation of said roller relative to said shaft.

5. The tool of claim 4 wherein said fluid flowing into and out of said annular space provides one or both of cooling and lubrication.

6. The tool of claim 5 wherein said fluid passageway is a cylindrical bore formed axially through said tool, said first zone of relatively high pressure having a first diameter and said second zone of relatively low pressure having a second smaller diameter.

7. The tool of claim 5 wherein each of said pockets is adapted to non-rotatably support axially opposite ends of said shaft.

8. The tool of claim 7 wherein said ends of said shaft are notched to provide fluid communication respectively between said first and second conduit means and said passages in said shaft.

9. The tool of claim 8 wherein said ends of said shaft are squared for insertion into correspondingly squared notches formed in said pocket.

10. The tool of claim 7 further including clamp means for fixedly securing said ends of said shaft in said pocket.

11. The tool of claim 3 wherein said means for placing said fluid passages in said shaft in fluid communication with said annular space comprise at least one ventilation passage extending through said shaft between each of said passages and said annular space.

12. The tool of claim 2 wherein said roller assembly further includes a sleeve member adapted to partially circumferentially enclose said roller and shaft, the outer dimensions of said sleeve member being selected to fit onto a respective pocket.

13. The tool of claim 12 wherein an inner surface of said sleeve member opposite said roller at least partially conforms to the shape of said roller for a minimal spacing therebetween to limit ingress of abrasive material between said inner surface and said roller.

14. The tool of claim 13 wherein said sleeve member circumferentially encloses more than half of said roller to prevent lateral separation of said roller from said sleeve member.

15. The tool of claim 14 further including wear rings respectively disposed between axially opposite ends of said sleeve member and said shaft.

16. The tool of claim 15 wherein said sleeve member circumferentially encloses more than half of said wear rings to prevent lateral separation therebetween.

17. The tool of claim 2 wherein at least a portion of an inner surface of said roller facing into said annular space is formed with helical thread means thereon to create turbulence to assist the flow of said fluid through said annular space.

18. The tool of claim 1 further including at least one longitudinally extending flute formed into an outer surface of said stabilizing tool to facilitate the passage of cuttings past said tool.

19. A roller assembly for a stabilizing tool used for drilling, the assembly comprising:

a roller; and a shaft to rotatably support said roller thereon with a sealed annular space defined between said roller and said shaft, said shaft including at each end thereof an axial fluid passage that extends only partially through said shaft and at least one ventilation passage placing each of said axial passages in fluid communication with said annular space, wherein said axial passages and said ventilation passages define a path for fluid to enter into and then exit from said sealed annular space.

20. The assembly of claim 19 further including bearing means disposed between said roller and said shaft to facilitate rotation of said roller.

21. The assembly of claim 20 wherein said bearing means are disposed in said annular space.

22. The assembly of claim 21 wherein said bearing means are ball bearings.

23. The assembly of claim 22 wherein said shaft and said roller are formed with races for said ball bearings.

24. The assembly of claim 23 wherein said bearing means are disposed between said ventilation passages to facilitate the cooling and lubrication thereof.

25. The assembly of claim 24 including sealing means disposed between said roller and said shaft for fluid tight sealing therebetween at axially opposite ends of said annular space.

26. A roller assembly for a stabilizing tool used for drilling, said tool having a pocket formed therein to receive said roller assembly, said roller assembly comprising:

a roller;

a shaft to rotatably support said roller thereon with a sealed annular space defined between said roller and said shaft, said shaft including at each end thereof an axial fluid passage that extends only partially through said shaft and at least one ventilation passage placing each of said axial passages in fluid communication with said annular space, wherein said axial passages and said ventilation passages define a path for fluid to enter into and then exit from said annular space; and a sleeve member adapted to partially circumferentially enclose said roller and said shaft, leaving said roller partially exposed for frictional contact with the surface of a bore hole being drilled, said sleeve means concentrically enclosing more than half of said roller to prevent lateral separation of said roller from said sleeve means.

27. The assembly of claim 26 wherein said sleeve member is externally dimensioned to fit into said pocket in said tool.

28. The assembly of claim 27 wherein an inner surface of said sleeve member is closely spaced from the outer surface of said roller to limit the ingress of abrasive material between said inner and outer surfaces.

29. The assembly of 28 wherein said sleeve member is medially split into two portions to facilitate an assembly of said member over said roller and shaft.

30. The assembly of claim 29 wherein axially opposite ends of said shaft extend axially outwardly from said sleeve means.

31. The assembly of claim 30 including a wear ring disposed between said axially extending ends of said shaft and said sleeve member.

32. A method of cooling a grinding roller disposed on the surface of a stabilizer tool used in the drilling of bore holes, the stabilizing tool having a bore formed axially therethrough for the flow of a drilling fluid, the method comprising the steps of:

rotatably mounting said roller on a shaft so that an annular space is defined between said roller and shaft;

sealing said annular space at axially opposite ends thereof;

directing a portion of the drilling fluid from said bore into said annular space; and redirecting said portion of the fluid from said annular space back to said bore.

33. A method of cooling a grinding roller disposed on the surface of a stabilizer tool used in the drilling of bore holes, the roller being rotatably mounted on a shaft supported in the tool, the method comprising the steps of:

providing a flow of drilling fluid through a passageway that extends axially through said stabilizer tool, said passageway having a first zone wherein the pressure of said drilling fluid is relatively high and a second zone wherein the pressure of said drilling fluid is relatively low;

directing a portion of said fluid through first conduit means from said first zone into a sealed annular space between said roller and said shaft; and directing said portion of said fluid through second conduit means from said annular space to said second zone.

* * * * *